US007478631B2

(12) United States Patent
Hueniken

(10) Patent No.: US 7,478,631 B2
(45) Date of Patent: Jan. 20, 2009

(54) PZEV EXHAUST GAS RECIRCULATION VALVE WITH ACTIVATED CARBON

(75) Inventor: Peter Curt Hueniken, Chatham (CA)

(73) Assignee: Siemens Canada Limited, Auburn Hills ( * ) Notice: Subject to any disclaimer, the term of this patent is extended or adjusted under 35 U.S.C. 154(b) by 0 days.

(21) Appl. No.: 11/790,537

(22) Filed: Apr. 26, 2007

(65) Prior Publication Data

US 2007/0256674 A1 Nov. 8, 2007

Related U.S. Application Data

(60) Provisional application No. 60/746,558, filed on May 5, 2006.

(51) Int. Cl.
*F02M 25/07* (2006.01)
*F02B 47/08* (2006.01)

(52) U.S. Cl. ..... 123/568.27; 123/568.29

(58) Field of Classification Search ..... 123/568.11, 123/568.27, 568.29, 190.17; 251/129.11, 251/321, 330, 331
See application file for complete search history.

(56) References Cited

U.S. PATENT DOCUMENTS 3,645,098 A * 2/1972 Templin et al. ..... 60/288
6,431,158 B1 8/2002 Gagnon et al.
6,502,564 B1 * 1/2003 Gagnon et al. ..... 123/568.27
6,715,475 B2 * 4/2004 Cook ..... 123/568.21
6,997,170 B2 * 2/2006 Feiner et al. ..... 123/568.29
7,278,410 B2 * 10/2007 Hoke et al. ..... 123/568.11
2005/0028798 A1 * 2/2005 Feiner et al. ..... 123/568.29
2007/0107705 A1 * 5/2007 Hoke et al. ..... 123/568.11

* cited by examiner

*Primary Examiner*—Stephen K Cronin
*Assistant Examiner*—Arnold Castro

(57) ABSTRACT

An exhaust gas recirculation valve includes a body including a passageway extending between an inlet and an outlet. The passageway communicates a flow of the exhaust gases. A bearing, disposed in the body, has a bearing passageway. A valve member is located in the passageway between the inlet and outlet and has a portion movably disposed in the bearing passageway such that a clearance path is defined between the portion of the valve member and the bearing. The clearance path is in communication with atmosphere through openings in the body. The valve member is constructed and arranged to regulate the flow of the exhaust gases. Activated carbon is associated with a portion of the body so as to adsorb hydrocarbons associated with the clearance path and thus prevent hydrocarbons from escaping to the atmosphere through the openings in the body.

20 Claims, 1 Drawing Sheet

PZEV EXHAUST GAS RECIRCULATION VALVE WITH ACTIVATED CARBON

This application claims the benefit of the earlier filing date of U.S. Provisional Application No. 60/746,558, filed on May 5, 2006, which is incorporated by reference herein in its entirety.

FIELD OF THE INVENTION

This invention relates to an automotive exhaust gas recirculation (EGR) valve and, more particularly, to an EGR valve having activated carbon to adsorb hydrocarbons associated with leak paths in the EGR valve.

BACKGROUND OF THE INVENTION

When a vehicle engine is turned off, unburned fuel vapor may migrate out of the vehicle's intake manifold and cause the total vehicle hydrocarbon emissions to exceed mandated levels. There are many points on the intake manifold where the fuel vapor can escape. Some fuel vapor may be emitted through leak paths in an EGR valve.

There are devices that capture fuel vapor when the engine is off and store it for the engine to re-ingest when the engine is turned on again. These devices are associated directly with an engines air intake system and not with an EGR valve.

Thus, there is a need to provide activated carbon in leak paths of an EGR valve.

SUMMARY OF THE INVENTION

An object of the invention is to fulfill the need referred to above. In accordance with the principles of the present invention, this objective is achieved by providing an exhaust gas recirculation valve for recirculating exhaust gases from an internal combustion engine to an intake manifold of the internal combustion engine. The valve includes a body including a passageway extending between an inlet and an outlet. The passageway communicates a flow of the exhaust gases. A bearing, disposed in the body, has a bearing passageway. A valve member is located in the passageway between the inlet and outlet and has a portion movably disposed in the bearing passageway such that a clearance path is defined between the portion of the valve member and the bearing. The clearance path is in communication with atmosphere through openings in the body. The valve member is constructed and arranged to regulate the flow of the exhaust gases. Activated carbon is associated with a portion of the body so as to adsorb hydrocarbons associated with the clearance path and thus prevent hydrocarbons from escaping to the atmosphere through the openings in the body.

In accordance with another aspect of the invention, a method of preventing hydrocarbons in an exhaust gas recirculation valve from escaping to atmosphere provides an exhaust gas recirculation valve for recirculating exhaust gases from an internal combustion engine to an intake manifold of the internal combustion engine. The valve includes a leak passage permitting hydrocarbons to leak to atmosphere. The method associates activated carbon with the leak passage to adsorb hydrocarbons and prevent the hydrocarbons from leaking to atmosphere.

Other objects, features and characteristics of the present invention, as well as the methods of operation and the functions of the related elements of the structure, the combination of parts and economics of manufacture will become more apparent upon consideration of the following detailed description and appended claims with reference to the accompanying drawings, all of which form a part of this specification.

BRIEF DESCRIPTION OF THE DRAWING

The invention will be better understood from the following detailed description of the preferred embodiments thereof, taken in conjunction with the accompanying drawing, in which.

DETAILED DESCRIPTION OF THE EXEMPLARY EMBODIMENT

Figure 1:
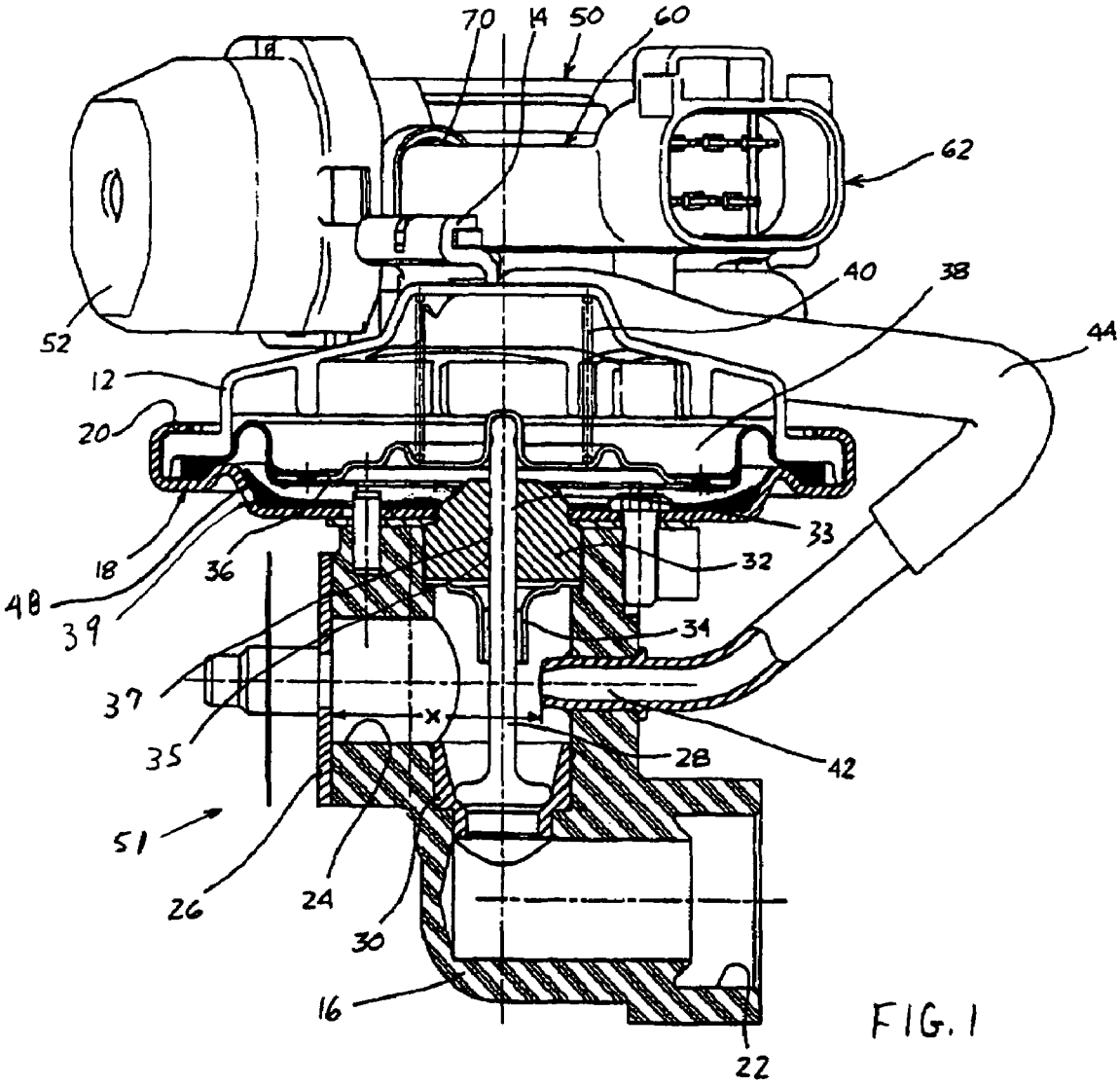
FIG. 1 is a front elevation view, partially in section, of an EGR system module provided in accordance with an embodiment of the present invention.

FIG. 1 illustrates an EGR system module 10 including an upper body 12 integrally connected with an electronic vacuum regulator (EVR) 50 and a differential pressure (DP) sensor 60. The EVR 50 includes a cap 52 with a filter inside the cap 52. The EVR 50 and the DP sensor 60 are in fluid communication via a connection 70. The DP sensor 60 is integrally connected with the upper body 12 via mounting rails 14. A multiple pin connector 62 for electrically interconnecting the EGR system module 10 to an ECU (not shown) can be integrally formed with the DP sensor 60.

Examples of EVR valves that may be used are disclosed in commonly assigned U.S. Pat. No. 5,448,981 to Cook et al. and U.S. Pat. No. 5,967,172 to Cook, which are incorporated herein in their entirety by reference.

The EGR system module 10 is used in a partial zero emissions vehicle (PZEV) and includes an EGR valve, generally indicated at 51, having a body 16 that is integrally connected with the upper body 12 via a cap 18. The cap 18 can be considered to be part of the body 16. Tabs 20 on the cap 18 can be deformed to clinch the upper body 12. This arrangement allows the upper body 12 to be rotated to a desired angular orientation with respect to the EGR body 16 during assembly. Thus, the EVR 50 and the DP sensor 60 can be oriented as desired in the finished EGR system module.

The EGR body 16 includes an exhaust gas inlet 22, which is adapted to be connected to an exhaust gas supply (not shown), and an exhaust gas outlet 24, which is adapted to be connected to an intake manifold (not shown). A gasket orifice 26 can be located at the exhaust gas outlet 24 to develop a pressure differential on either side of the gasket orifice 26 and to provide a seal for the connection to the EGR body 16. Specifically, the gasket orifice 26 can be formed as a thin gasket that seals the EGR body 16 onto the intake manifold (not shown). The gasket orifice 26 can be made of stainless steel, which provides dimensional stability at high temperatures. Of course, other materials exhibiting similar properties can be used.

The relative spacing between a valve member or pintle 28 and a seat 30 regulates the flow of exhaust gas from the inlet 22 to the outlet 24. The pintle 28 is moveably mounted with respect to the EGR body 16 by a bearing 32. More particularly, a stem portion 33 of the pintle 28 is disposed in a bearing passage 35 such that a clearance path 37 is defined between the stem portion 33 and the bearing 32. This clearance path 37 is in communication with atmosphere through openings 39 in the lower portion of the cap 18 and is a source of hydrocarbon leaks to atmosphere, as will be explained below.

A stem shield 34 can protect the bearing 32 from contact with hot exhaust gases. The pintle 28 is connected to a diaphragm 36 that is clamped around its periphery between the upper body 18 and the cap 18. The diaphragm 36 serves as an actuator wall that is movable in response to vacuum in a chamber 38. As is known, the intake manifold (not shown) provides the source of vacuum for the chamber 38. A spring 40 normally biases the diaphragm 36 and the pintle 28 to a closed position with respect to the seat 30.

The DP sensor 60 measures the pressures on either side of the gasket orifice 26. An internal passage 42 that extends through the EGR body 16, and a hose 44, provide the DP sensor 60 with the pressure signal from the upstream side, i.e., exhaust manifold side, of the gasket orifice 26. The internal passage 42 is opposite the outlet 24 and aligned with the gasket orifice 26. This arrangement ensures greater accuracy making EGR flow readings and simplifies the manufacturing process since the bores for the outlet 24 and the internal passage 42 can be machined in a single operation. The optimal range for the spacing "X" (see FIG. 5) between the gasket orifice 26 and the internal passage 42 has been found to be approximately 15 to 25 millimeters.

The DP sensor 60 can be connected directly to the intake manifold (not shown) on the downstream side of the gasket orifice 26. The DP sensor 60 and the EVR valve 50 can both be connected to the intake manifold (not shown) via a common port that provides a source of vacuum for both the chamber 38 (as regulated by the EVR valve 50) and the DP sensor 60.

The DP sensor 60 continually computes a differential pressure value on either side of the gasket orifice 26 and provides this data to an ECU (not shown), which uses this data to compute an EVR control signal.

There are possible hydrocarbons leak paths to atmosphere in the EGR system module 10. For example, as noted above, one leak path is the clearance path 37 between the bearing 32 and stem portion 33 of the pintle 28 that communicates with the opening in the body 18 and thus with the atmosphere.

In accordance with the embodiment, activated carbon 48 is provided in the leak paths. More particularly, in the embodiment, activate carbon 48 is associated with (e.g., carried by) the cap 18 of the body 16 so as to adsorb hydrocarbons and thus prevent hydrocarbons from escaping to the atmosphere through the openings 39 in the cap 18 of the body 16. The activated carbon 48 works by using the hydrocarbon adsorption and desorption properties of activated charcoal in a cloth substrate form, a pellet form, a granular form, a puck form, or any other form. By placing the activated charcoal 48 into the leak path(s) of the escaping hydrocarbons through EGR valve 51 during engine-off conditions, the hydrocarbons can be trapped before they are released into the atmosphere. During engine-on conditions the immediate, high temperature of the EGR valve 51 and specifically the high temperature of the cap 18 is transferred to the activated charcoal 48. The heated activated charcoal 48 effectively causes hydrocarbon desorption out of the activated charcoal 48. Normal engine vacuum then draws the released hydrocarbon back into the intake manifold (not shown) where it is available to the engine for combustion.

The EGR system module 10 with activated carbon 48 in the EGR valve 51 is configured to adsorb (trap) hydrocarbons associated with the EGR leak paths during engine-off cycles and desorb (purge) hydrocarbons during engine drive cycles. The EGR system module 10 with activated carbon 48 in the EGR valve 51 must survive high temperatures and should be of low cost and easily implemented into current production.

The foregoing preferred embodiments have been shown and described for the purposes of illustrating the structural and functional principles of the present invention, as well as illustrating the methods of employing the preferred embodiments and are subject to change without departing from such principles. Therefore, this invention includes all modifications encompassed within the spirit of the following claims.

What is claimed is:

1. An exhaust gas recirculation valve for recirculating exhaust gases from an internal combustion engine to an intake manifold of the internal combustion engine, the valve comprising:

a body including a passageway extending between an inlet and an outlet, the passageway communicating a flow of the exhaust gases;

a bearing disposed in the body, the bearing having a bearing passageway, a valve member located in the passageway between the inlet and outlet, the valve member having a portion movably disposed in the bearing passageway such that a clearance path is defined between the portion of the valve member and the bearing, the clearance path being in communication with atmosphere through openings in the body, the valve member being constructed and arranged to regulate the flow of the exhaust gases; and activated carbon associated with a portion of the body so as to adsorb hydrocarbons associated with the clearance path and thus prevent hydrocarbons from escaping to the atmosphere through the openings in the body, wherein the activated carbon one of covers surfaces defining the openings or is disposed within the openings.

2. The valve of claim 1, wherein the portion of the body is a cap constructed and arranged to be coupled to an electric vacuum regulator (EVR).

3. The valve of claim 2, wherein the activated carbon is activated charcoal in one of a cloth substrate form, a pellet form, a granular form, or a puck form.

4. The valve of claim 3, wherein the activated charcoal is constructed and arranged to adsorb hydrocarbons associated with the clearance path and during engine-off cycles and desorb hydrocarbons during engine drive cycles.

5. The valve of claim 2, wherein the openings are defined in a bottom surface of the cap and activated carbon is a cloth substrate form substantially covering the bottom surface of the cap, thus covering the opening.

6. The valve of claim 1, further comprising a diaphragm having a first portion fixed to the portion of the valve member, a second portion fixed with respect to the body, and a flexible portion connecting the first and second portions.

7. The valve of claim 6, wherein the body includes a cap and the diaphragm is clamped between the cap and an upper body.

8. The valve of claim 7, wherein the diaphragm and the upper body define a chamber adapted to be in fluid communication with a supply of vacuum in the intake manifold.

9. The valve of claim 8, in combination with an electric vacuum regulator valve regulating the supply of vacuum to the chamber.

10. The combination of claim 9, further in combination with a differential pressure sensor constructed and arranged measure pressure associated with the outlet.

11. An exhaust gas recirculation valve for recirculating exhaust gases from an internal combustion engine to an intake manifold of the internal combustion engine, the valve comprising:

a body including a passageway extending between an inlet and an outlet, the passageway communicating a flow of the exhaust gases;

a bearing disposed in the body, the bearing having a bearing passageway, a valve member located in the passageway between the inlet and outlet, the valve member having a portion movably disposed in the bearing passageway such that a clearance path is defined between the portion of the valve member and the bearing, the clearance path being in communication with atmosphere through openings in the body, the valve member being constructed and arranged to regulate the flow of the exhaust gases; and means, associated with a portion of the body, for adsorbing hydrocarbons associated with the clearance path and thus prevent hydrocarbons from escaping to the atmosphere through the openings in the body, wherein the means for adsorbing one of covers surfaces defining the opening or is disposed within the openings.

12. The valve of claim 11, wherein the portion of the body is a cap constructed and arranged to be coupled to an electric vacuum regulator (EVR).

13. The valve of claim 11, wherein the means for adsorbing is constructed and arranged to adsorb hydrocarbons associated with the clearance path and during engine-off cycles and desorb hydrocarbons during engine drive cycles.

14. The valve of claim 13, wherein the means for adsorbing is activated charcoal in one of a cloth substrate form, a pellet form, a granular form, or a puck form.

15. The valve of claim 14, wherein the openings are defined in a bottom surface of the cap and activated charcoal is a cloth substrate form substantially covering the bottom surface of cap, thus covering the openings.

16. A method of preventing hydrocarbons in an exhaust gas recirculation valve from escaping to atmosphere, the method comprising:

providing an exhaust gas recirculation valve for recirculating exhaust gases from an internal combustion engine to an intake manifold of the internal combustion engine, the valve including a leak passage permitting hydrocarbons to leak to atmosphere, and providing activated carbon to one of cover surfaces defining the leak passage or be disposed within the leak passage to adsorb hydrocarbons and prevent the hydrocarbons from leaking to atmosphere.

17. The method of claim 16, wherein the step of providing the valve provides a valve comprising:

a body including a passageway extending between an inlet and an outlet, the passageway communicating a flow of the exhaust gases;

a bearing disposed in the body, the bearing having a bearing passageway, and a valve member located in the passageway between the inlet and outlet, the valve member being constructed and arranged to regulate the flow of the exhaust gases, the valve member having a portion movably disposed in the bearing passageway such that a clearance path is defined between the portion of the valve member and the bearing, the clearance path being in communication with atmosphere through openings in the body, the openings defining the leak passage.

18. The method of claim 17, wherein the body includes a cap, the openings are defined in the bottom surface of the cap and activated carbon is a cloth substrate form substantially covering the bottom surface the cap, thus covering the openings.

19. The method of claim 17, wherein the activated carbon is activated charcoal in one of a cloth substrate form, a pellet form, a granular form, or a puck form.

20. The method of claim 17, wherein the activated carbon is constructed and arranged to adsorb hydrocarbons associated with the leak passage during engine-off cycles and desorb hydrocarbons during engine drive cycles.

* * * * *